United States Patent [19]

Rowe

[11] Patent Number: 4,475,067

[45] Date of Patent: Oct. 2, 1984

[54] DOOR LOCK ILLUMINATING DEVICE

[76] Inventor: Donald L. Rowe, Rte. 12, Box 101, Winston-Salem, N.C. 27107

[21] Appl. No.: 382,925

[22] Filed: May 28, 1982

[51] Int. Cl.[3] ..... H05B 37/02

[52] U.S. Cl. ..... 315/360; 315/200 R; 315/207; 315/208; 362/100

[58] Field of Search ..... 315/360, 362, 200 R, 315/207, 208; 362/100

[56] References Cited

U.S. PATENT DOCUMENTS

| | | | |
|---|---|---|---|
| 3,965,465 | 6/1976 | Alexander | 315/360 |
| 4,293,894 | 10/1981 | Blank | 362/100 |
| 4,339,696 | 7/1982 | Jabor | 315/362 |
| 4,389,599 | 6/1983 | Jabor | 315/360 |

*Primary Examiner*—Harold Dixon

*Attorney, Agent, or Firm*—Charles R. Rhodes; Judith G. Smith

[57] ABSTRACT

A device for illuminating the area surrounding a door lock or other relatively small area includes in a preferred embodiment a housing that is mounted on the door or other surface adjacent the area to be illuminated, the housing having a translucent portion through which an electrically energized lamp emits light. The lamp is energized by a battery connected thereto by an electronic circuit having a time-delay sub-circuit for de-energizing the lamp at the expiration of a prescribed time period. The time-delay sub-circuit further includes a means for varying the period of time that the lamp is energized.

3 Claims, 5 Drawing Figures

DOOR LOCK ILLUMINATING DEVICE

BACKGROUND OF THE INVENTION

The present invention is related to battery operated illuminating devices, which in preferred embodiments are designed for illuminating the area surrounding a doorknob or lock and key hole. The desirability of illuminating the lock area while an individual is trying to unlock a door and enter a residence or place of business is well known. Equally well known is the use of various small illuminating devices that are attached to the door or built into the door and used for illuminating the lock area for a prescribed period of time.

The prior art reveals numerous patents directed to such devices. Some of the later ones include electronic time-delay circuits whereby an individual utilizes a switch to selectively connect an energy source to the lamp; the lamp is energized for a pre-set period of time; and when the preset period of time has expired, the time-delay circuit automatically de-energizes the lamp. Two patents which are known to include time-delay mechanisms are the ones to Bartick U.S. Pat. No. 3,590,234, and to Blank U.S. Pat. No. 4,293,894.

The Bartick patent discloses a small illuminating device that includes a vacuum cup controlled time-delay actuator. When an individual approaches the door on which the Bartick illuminating device is mounted, they must be able to exert sufficient pressure on the pushbutton to constrict the vacuum cup to allow the switch arm to make contact and operate the lamp. If the applied force is not sufficient to properly engage the vacuum cup, the timing can be erratic and it is possible to have to repeatedly activate the illuminating device before the lock is successfully opened. Additionally, the Bartick device is complex and thereby expensive to manufacture and prone to failure over a period of time.

The Blank U.S. Pat. No. 4,293,894 is directed to a timing circuit in an illuminating device; the timing circuit having a pre-set, non-variable time-delay means for energizing the lamp. The time-delay device is an integrated circuit which cannot be varied by the individual owner. If the pre-set time is not appropriate for the owner's particular requirements, there is no means for making adjustment absent the actual removal of various components and replacement with totally different component values. This is beyond the ability of most consumers. Additionally, the electronic circuit disclosed by Blank is in many instances inadequate to energize a lamp of sufficient illumination for enlarged areas.

The present invention is an improved battery operated illuminating device, operative by means of an electronic time-delay circuit which can be manually adjusted by the owner with ease. Although described herein as being battery powered, the illumination device may be connected to the building's central electrical system and the battery eliminated.

Additionally, the electronic circuit itself, whether of an adjustable or of a fixed time delay design, is an improved means for providing a time-delay circuit to other types of illuminating devices or small appliances. By means of the improved variable circuit, the time-delay means may be pre-set for a period of approximately nine to ninety seconds and adjusted as required by the individual owner. It may be reset to vary the time-delay circuit as needed. The alternate, fixed time-delay circuit is believed to be more efficient and economical to produce than known circuits. The specifics of both circuits are described in the detailed description that follows.

The illuminating device of the present invention includes in the preferred embodiment a relatively small housing having a first, opaque portion that houses and conceals the electronic circuit board and battery, and a second portion that is translucent and surrounds the lamp. The preferred housing is basically rectangular in shape and is attached to the door (or other surface adjacent the area to be illuminate) by means of screws or pressure sensitive material along an underside of the housing. The illuminating device is positioned on the door or other surface such that it is adjacent the lock and can be easily reached and activated by an individual who may frequently be carrying packages or other objects. The translucent portion is preferably most closely adjacent the lock, and the light emitted therethrough will illuminate the area for the predetermined time of approximately nine to ninety seconds after the switch is actuated. Because of the improved circuitry, a lamp of greater candle power than heretofore possible has been utilized. Thus, a much larger area of the surrounding door is illuminated. When the switch is activated to energize the lamp, the time delay circuit begins to function and at the end of the prescribed period of time de-energizes the lamp.

The objects of the present invention therefore include: the provision of an improved device for illuminating any small area such as the doorknob and key hole area of an entry; the provision of an electronic time-delay circuit which can be easily, manually adjusted by the owner to vary the preset time interval; the provision of an improved electronic, fixed or variable timing circuit for deenergizing the lamp after a predetermined prescribed time and the provision of a circuit sufficient to energize a lamp of at least 0.5 candle power.

Other objects, features and advantages of the invention will become apparent to those skilled in the art as the following detailed description is studied in conjunction with the attached drawings of which:

Figure 3A:
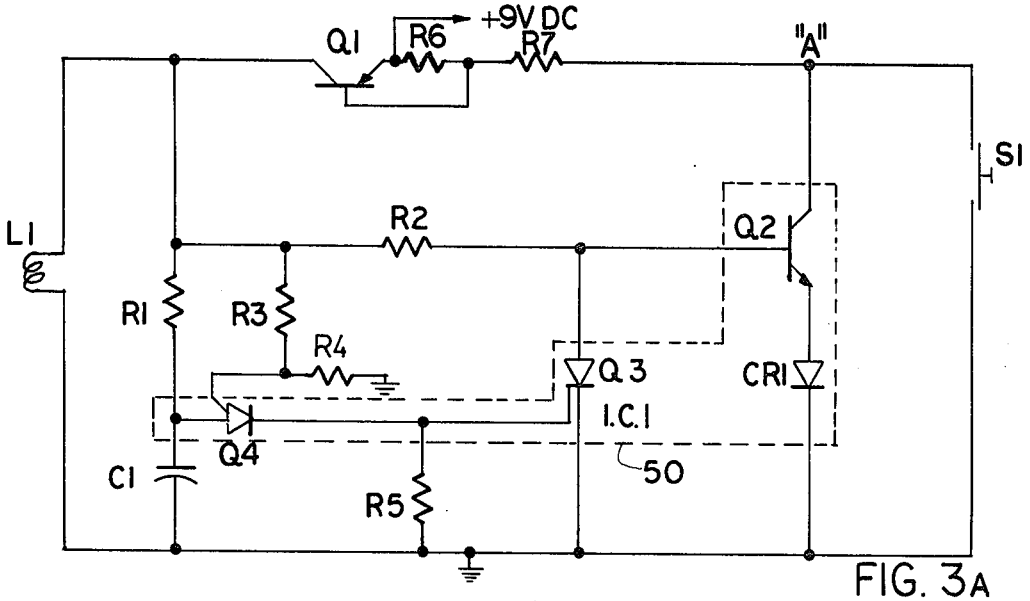
Figure 3B:
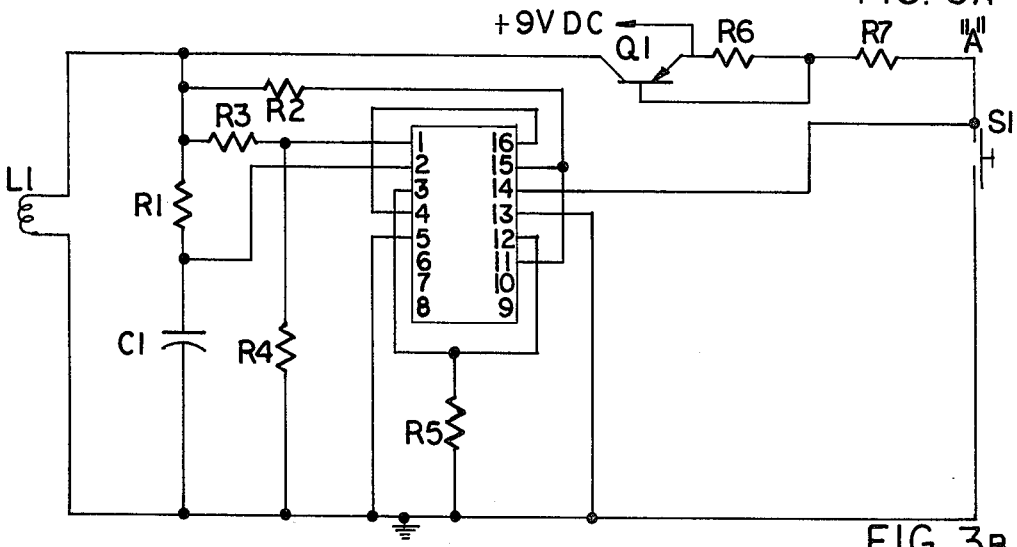

FIG. 3*a* is a detailed schematic of the integrated circuit used in the fixed time-delay circuit shown in FIG. 3*b;*

Figure 4:
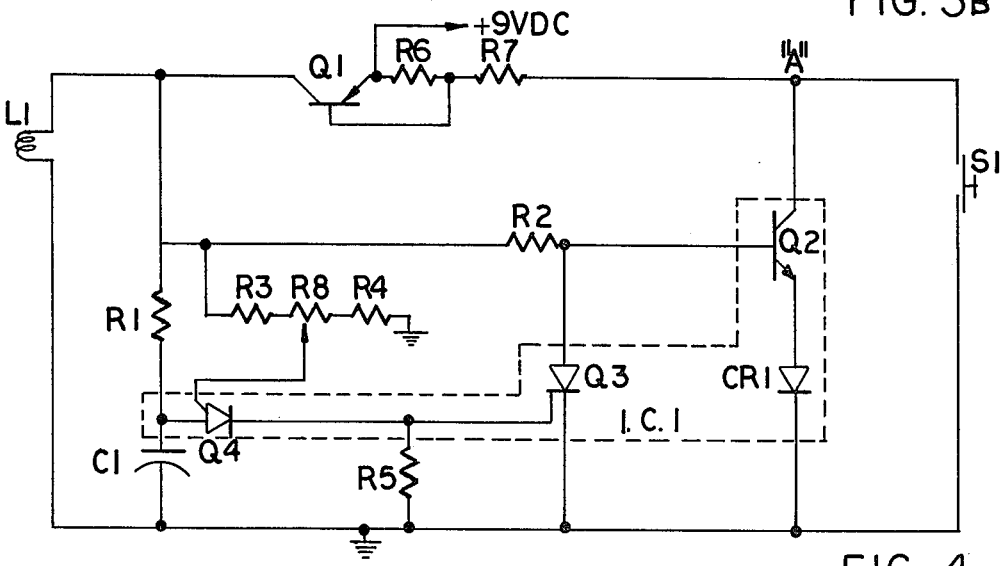

FIG. 3*b* is a schematic of the fixed time-delay circuit;

FIG. 4 is a schematic of the variable time-delay electronic circuit.

DETAILED DESCRIPTION OF A PREFERRED EMBODIMENT

Figure 1:
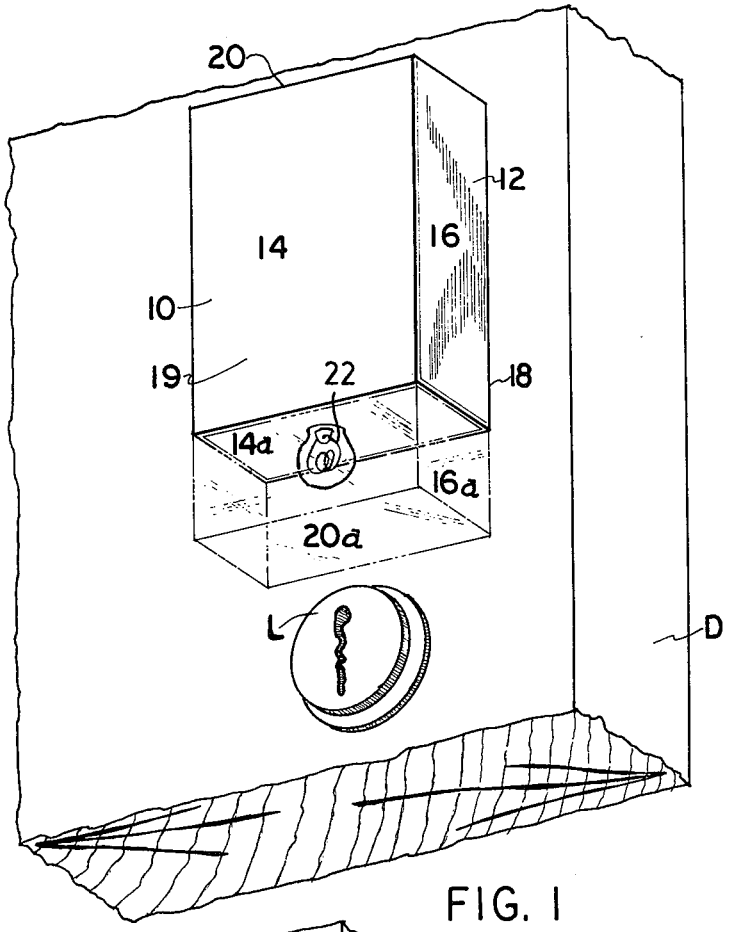
FIG. 1 is a perspective view of a preferred embodiment of the illuminating device as it would be mounted above a door lock.

Looking first at FIG. 1, an embodiment of the present invention is shown as it would be installed on an existing door. The illumination device 10 is basically an elongated rectangular shape having a housing 12 with a front wall 14, side walls 16, and a rear wall 18 that is not visible in the drawing. As illustrated the housing is mounted on an existing door D just above the lock L which, in this instance, is illustrated as being above a doorknob which is not shown. The illumination device 10 is applied to the existing door by means of a pressure sensitive material on the rear wall 18, or, although not illustrated, screws which are inserted through the rear wall into the door. The housing 12 is formed substantially of separable elements wherein the power source, the electronic circuitry, and the lamp are all mounted on the inner surface of the rear wall 18, and the top and side walls 14,16 form a cover 19 which is snap-fitted to the rear wall. The primary or greater portions of the walls of the housing 14,16 are opaque material to shield from view the inner elements of the illumination device. The lower portion of each wall, at 14*a* and 16*a*, are made from a translucent material so that light can be emitted therethrough. The two end walls, 20,20*a* are integral with the side walls, wall 20 being opaque and 20*a* being translucent. The materials used may be of any type that can be economically formed into an acceptable shape, such as molded plastics, lightweight decorative metals or the like. As previously mentioned the upper or cover portion 19 is separable from the rear wall 18 by means of a snap-lock fit or other conventional mechanism which is not described in detail herein. Because of the separable characteristic, the owner has easy access to the operative element of the device for replacement of batteries, bulbs or for adjustment of the variable time-delay circuit, which adjustment will be described below.

Figure 2:
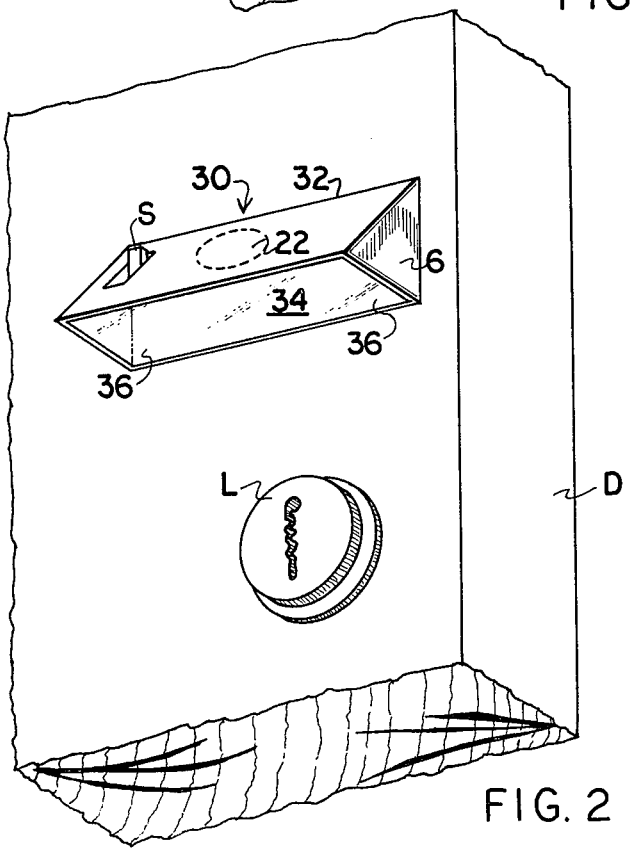
FIG. 2 is a perspective view of the illumination device according to an alternate embodiment.

FIG. 2 illustrates an alternate but also preferred embodiment of the illumination device. In this embodiment the device is designed primarily for construction into new doors and the operative elements are actually encased in the door. It is in this embodiment that it is most desirable to connect the illuminator to the building's central electrical system rather than utilizing a battery power source. As shown in FIG. 2 the illumination device 30 is comprised of a lamp that is operatively connected to an electronic circuit which will be described below. The operative elements are positioned on a plate or base, much as housing wall 18 described in FIG. 1, which plate or base, in this embodiment, is recessed into the door. Overlying the working elements is a reflective device 32. The lamp 22 (shown in dotted lines) extends through an aperture in the rear wall 34 of the reflective device. The light emitted from the lamp is reflected downwardly by the reflector 32 toward the key or door lock. The reflector 32 is positioned over the recessed circuit plate and attached by screws, tacks, or other conventional means 36 to the door. If the reflector is not formed of a naturally reflective material, the inner surface of the reflector should be coated with a reflective coating to enhance the deflection of the light rays downwardly toward the door look. A switch S is shown on the reflector and on the side wall 6 of the housing shown in FIG. 1. The switch may of course be positioned in another adjacent area if desired.

In use, a person approaching the door depresses or throws switch S which applies a positive source of energy from the battery, or otherwise connects an energy source to the lamp. The time-delay circuit is thereby activated to energize the lamp, which lamp is automatically deenergized at the expiration of a preset period. The lamp can be adjusted to stay on for a range of time of approximately nine seconds to ninety seconds. If the time-delay circuit is set for a ninety second interval and the individual desires a shorter interval, the variable time-delay circuit may be adjusted as appropriate. The enabling electronics which are illustrated in FIGS. 3 through 5 are described below.

Looking first at FIG. 3*a*, there is included the overall lamp circuit, as well as a detailed schematic of the integrated circuit 50. The timer circuit includes first of all an "ON-OFF" switch S1 with a fixed time limit when the switch is in the "ON" condition. Operatively, by closing switch S1 and placing the resistor R7 to ground, the transistor Q1 is biased into an "ON" or conducting condition and illuminates lamp L1 (22 in the perspective views). The remainder of the circuit is for the purpose of performing the timing function and includes basically an integrated circuit 50 which is basically a thyristor/-transistor array (linear integrated circuit). It should be noted that transistors Q2, Q4, the silicon controlled rectifier and the diode CR1 are arranged as shown in FIG. 1 and are available in a prepackaged integrated delay circuit of a type manufactured by RCA and sold under the designation P/N CA3097E. Continuing now with the schematic, at the time the switch S1 is moved to the "ON" position, a positive voltage is also placed on the base of transistor Q2 through resistor R2 causing the collector of transistor Q2 to be in a low state (Q2 is turned on and conducting). Contact "A" is now automatically held to ground through Q2 and diode CR1. The bias voltage at the junction of R3 and R4 establishes the amount of time the capacitor C1 is allowed the charge. The normal amount of time is approximately twenty-five seconds. When discharging or firing takes place, the positive pulse from Q4 circuit is felt on the gate of the silicon controlled rectifier Q3. This positive pulse then turns Q3 to the "ON" state and its collector is low. Such action at Q3 turns the transistor Q2 to the "OFF" position and its collector will return to the high state. This in turn breaks the ground at contact "A". At that instance the ungrounded transistor Q1 moves to the "OFF" position and the lamp L1 is deenergized. The circuit is at that point in a standby state.

Looking now at FIG. 4, the schematic illustrated is similar to that shown in FIG. 3A with the exception that the adjustable timer circuit wherein the individual owner may adjust the time-delay circuit for a period of time as desired in a range from approximately nine seconds to ninety seconds. The difference in this circuit is the introduction of variable resistor $R_8$. The adjustment of resistor $R_8$ establishes the amount of time that the capacitor C1 is allowed to charge. The time adjustment may be made for a period ranging from approximately nine seconds to ninety seconds.

The manual adjustments to resistor $R_8$ are made by rotation of a knob conventionally provided with such types of variable resistors in the appropriate direction to decrease or increase the resistance, and thereby correspondingly adjust the time delay interval. Resistor $R_8$ is a 500K, ¼ watt variable potentiometer, of the type manufactured by numerous manufacturers and marketed as a stock item.

The base plate or rear wall 18 of the housing has mounted thereon a printed circuit board with suitable electronic components, such as previously described, assembled and mounted thereon. The printed circuit board has assembled thereto an illuminating lamp 22 of approximately 0.52 candle power, and a battery power source which is the source of energy to the electronic components. Either of the circuits illustrated in FIGS. 3 and 4 may be used with a 9-volt alkaline battery or a 9 VDC battery eliminator.

The improved circuitry permits the use of a lamp 22 as described with increased candle power over known prior devices. The improved circuit which provides this capability is comprised of components having representative values as follows. In FIGS. 3*a* and 3*b*: the battery energy source is 9-volt; resistor $R_1$ is 3.0 meg; resistor $R_2$ is 1.2K; resistor $R_3$ is 3.3K; resistor $R_4$ is 9.1K; resistor $R_5$ is 120 ohms; resistor $R_6$ is 270 ohms; resistor $R_7$ is 220 ohms; capacitor C1 is 4.7 mfd; transistor Q1 is 2N4403; switch S1 is N.O. push button.

The adjustable or variable time-delay circuit schematically shown in FIG. 4 is comprised of components having representative values as follows: resistor $R_1$ 3.9 meg; resistor $R_2$ 1.2K; resistor $R_3$ is 110K; resistor $R_4$ is 150K; resistor $R_5$ is 120 ohms; resistor $R_6$ is 270 ohms; resistor $R_7$ is 220 ohms; capacitor C1 is 10 mfd; transistor Q1 is 2N4403; switch S1 is N.O. push button. Resistor $R_8$ is as previously described 500K.

It is believed that the above circuit descriptions are enabling of an improved illumination device of a nature used to illuminate the area around a door lock. However, it would be equally appropriate for use in other areas where relatively small illumination apparatuses are desired. The housings as described in FIG. 1 may be of molded plastics or other appropriate materials; may be in a rectangular shape as illustrated or any other desired shape so long as the base plate 18 is sufficient for mounting the electronic component and has adequate area for applying an adhesive pressure sensitive material. The external reflecting device 32 shown in FIG. 2 may be fabricated from decorative materials in a style compatible with the selected hardware, materials including brass, copper, coated plastics and the like. The overall dimensions of the respective housings are not limited. The embodiment shown in FIG. 1 is preferably three inches by two inches by one inch, but adjustments may be made as desired. The width of the reflector shown in FIG. 2 would be approximately two to three inches in a preferred embodiment.

While it is to be understood that the above description of the two embodiments has been of preferred approaches, other and various adaptations and modifications can be made to the illumination device while remaining within the scope of the invention claimed below.

What is claimed is:

1. An electronic timing circuit connecting a power source to a load, said circuit including:

(a) first semi-conductor means connected in series with said load and said voltage source, said first semi-conductor means having base control means for switching said semi-conductor between two conditions when said base control means is grounded; said two conditions including:

(i) an on condition in which said first semi-conductor is open;

(ii) an on condition in which said first semi-conductor means is closed;

(iii) said base control means including a normally open manual switch and a second transistor in shunt thereto for grounding said base;

(b) an integrated circuit means for maintaining said first semi-conductor in the closed position for a prescribed period of time, said integrated circuit comprising a time delay circuit energized during said on condition and connected for controlling said second semi-conductor means;

whereby said second semi-conductor and said time delay circuit act as a hold on contact for said prescribed time period.

2. An illumination device comprising a housing, an electrically operable lamp, a source of energy to said lamp, a switch means for activating said energy source, and an electronic timing circuit including:

(a) first semi-conductor means connected in series with said lamp and said voltage source, said first semi-conductor means having base control means for switching said semi-conductor between two conditions when said base control means is grounded; said two conditions including:

(i) an off condition in which said first semi-conductor is open;

(ii) an on condition in which said first semi-conductor means is closed;

(iii) said base control means including a normally open manual switch and a second transistor in shunt thereto for grounding said base;

(b) an integrated circuit means for maintaining said first semi-conductor in the closed position for a prescribed period of time, said integrated circuit comprising a time delay circuit energized during said on condition and connected for controlling said second semi-conductor means; whereby said second semi-conductor and said time delay circuit act as a hold on contact for said prescribed time period.

3. An illumination device according to claim 2 wherein said integrated circuit is of a type described thyristor/transistor array.

* * * * *